US007726913B1

(12) United States Patent
Sjogren

(10) Patent No.: US 7,726,913 B1
(45) Date of Patent: Jun. 1, 2010

(54) METHOD AND APPARATUS FOR FORMING IN GROUND PILES

(76) Inventor: David Sjogren, 25008 163rd Pl. SE., Covington, WA (US) 98042

( * ) Notice: Subject to any disclaimer, the term of this patent is extended or adjusted under 35 U.S.C. 154(b) by 286 days.

(21) Appl. No.: 11/839,089

(22) Filed: Aug. 15, 2007

(51) Int. Cl.
*E02B 7/00* (2006.01)

(52) U.S. Cl. ..... 405/232; 405/233; 405/240; 405/248; 166/289; 166/334.1; 166/334.4; 166/242.8

(58) Field of Classification Search ..... 405/236, 405/240, 248, 233, 232, 235, 231; 166/289, 166/290, 334.1, 334.3, 334.4, 242.7, 242.8; 251/121, 122
See application file for complete search history.

(56) References Cited

U.S. PATENT DOCUMENTS

| | | | | |
|---|---|---|---|---|
| 1,157,443 | A | 11/1915 | Stewart | |
| 1,477,567 | A | 12/1923 | Lancaster | |
| 2,326,872 | A | 8/1943 | Marsden | |
| 2,926,500 | A | 3/1960 | Hoppe | |
| 3,084,518 | A | 4/1963 | Hochstrasser | |
| 3,869,869 | A | 3/1975 | Chen | |
| 4,018,056 | A | 4/1977 | Poma | |
| 4,126,007 | A | 11/1978 | Mars | |
| 4,397,588 | A | 8/1983 | Goughnour | |
| 4,618,289 | A | 10/1986 | Federer | |
| 4,730,954 | A | 3/1988 | Sliwinski | |
| 4,992,002 | A * | 2/1991 | DeWitt | 405/237 |
| 5,279,502 | A | 1/1994 | Goughnour | |
| 5,282,701 | A | 2/1994 | An et al. | |
| 5,419,658 | A | 5/1995 | DeWitt | |
| 5,501,550 | A | 3/1996 | Calabrese | |
| 5,549,168 | A | 8/1996 | Sadler et al. | |
| 6,773,208 | B2 | 8/2004 | DeWitt et al. | |

FOREIGN PATENT DOCUMENTS

| | | |
|---|---|---|
| EP | 0084921 | 8/1986 |
| FR | 708148 | 7/1931 |
| JP | 08035227 A * | 2/1996 |

OTHER PUBLICATIONS

J & M Foundation Equipment brochure, date unknown,12 pages, Pittsburgh, Pennsylvania, USA.
American Piledriving Equipment, Inc. brochure, Building The World's Foundations, 2006, 48 pages, Kent, Washington, USA.
Tunkers, Vibro Hammer, 2006, 1 page, http://www.pileco.com/eng/tunkers-4-pic.htm.
Tunkers, Vibro Hammer, 2006, 1 page, http://www.pileco.com/eng/tunkers-5-pic.htm.

* cited by examiner

*Primary Examiner*—David J Bagnell
*Assistant Examiner*—Sean D Andrish
(74) *Attorney, Agent, or Firm*—Michael R. Schacht; Schacht Law Office, Inc.

(57) ABSTRACT

The present invention is an apparatus and a method for casting a cementitious or stone pile into the ground. The present invention comprises an exterior driving casing and an interior mandrel acting in cooperation to hold and deliver the pile forming material. A retrievable driving driving shoe is also disclose.

20 Claims, 3 Drawing Sheets

METHOD AND APPARATUS FOR FORMING IN GROUND PILES

CROSS-REFERENCE TO RELATED APPLICATIONS

Not applicable

STATEMENT REGARDING FEDERALLY SPONSORED RESEARCH

Not applicable

SEQUENCE LISTING

Not applicable

BACKGROUND OF THE INVENTION

1. Field of the Invention

This invention relates to a method and apparatus for placing in-ground piles of either crushed stone or rock, grout or concrete, or some combination thereof.

2. Description of Prior Art

It has been known in the prior art, to make pilings from concrete by casting them in place in the ground. This is accomplished by driving an elongate mandrel, i.e., a hollow tube of a selected cross-sectional area, into the ground, filling the resultant hole with fluid grout, and then pulling the mandrel back out of the ground leaving the grout in place to cure. The holding ability of such a piling comes from end-bearing and from the friction which is created by the close contact between the pile's sidewalls and the surrounding soil. It has also become standard practice to place a foot, aka, pile driving shoe, having a larger cross-sectional area than the mandrel, at the bottom of the mandrel before it is driven into the ground. The foot forms an open space around the mandrel. The hole created by the driving of the mandrel is filled with grout, i.e., cementitious fluid, stones, or rock. In the prior art grout may be gravity fed into and/or around the mandrel as it is being driven into the ground. See, e.g., Steding, U.S. Pat. No. 3,851,485 and Poma, U.S. Pat. No. 4,018,056.

A significant problem with the gravity feed method is that the grout often cannot flow into the hole fast enough to keep up with its formation, thereby resulting in voids. If soil or objects in the soil fall into these voids, the resultant pile diameter will neck down at the locations of the voids, weakening the pile. Other prior art devices have attempted to overcome this problem by pumping the grout into the mandrel under positive pressure as the mandrel is being driven. See, e.g., Hochstrasser, U.S. Pat. No. 3,084,518 and Federer, U.S. Pat. No. 4,618,289. However, pumping grout is also very problematic due to the inability to maintain a sufficient volumetric flow rate due to grout's the high viscosity. Accordingly, pumping is sometimes no more effective than gravity filling.

A twist on the gravity fed approach is seen in DeWitt, U.S. Pat. No. 4,992,002. In DeWitt, the mandrel is filled with grout prior to driving into the ground. A irretrievable steel foot is placed at the bottom the mandrel, which prevents the premature release of the grout. When the desired depth is reached, the mandrel is lifted out of the ground, leaving the foot behind and the grout flows out the bottom of the mandrel.

All of the aforementioned approaches are subject to the problem of necking, because no exterior reinforcing casing is provided. The grout will be still be subject to necking as the mandrel is withdrawn. Without an exterior reinforcing casing there is no reinforcement against side-loading from earth movements, wind and other influences. Accordingly, excess concrete or grout must be pumped at the top of the hole to prevent the collapse of the hole. This adds to the cost of the pile.

To provide the necessary reinforcement, the use of a full-length exterior reinforcing casing has been adopted in some circumstances. However, this is also less than ideal because the exterior casing is permanently left in the ground, thereby increasing the costs for each pile.

Moreover, the aforementioned prior art devices suffer from lack of durability. All of the prior art devices teach the use of pile driving a single mandrel into the earth. Accordingly, the mandrel must be made of very sturdy material such as heavy steel to withstand the blows of the pile driving hammer and the resultant reactionary forces of the earth. It is not uncommon for such mandrels, despite their sturdiness, to deflect during the driving process, which in turn will lead to inadequate pile formation or lost time. In time, such mandrels may have to be scrapped because they have lost their straightness or because they cannot withstand the blows of the pile driver. This is wasteful and expensive.

Additionally, the aforementioned devices do not accommodate the attachment of a vibrator without the need to halt the process. A vibrator is often used to assist in the delivery of pile forming material, such as stone, crushed rock or aggregate, or some combination thereof, into the resultant hole. The vibrator is clamped on to the mandrel and vibrates the mandrel. Prior to initiating the vibrator, the pile driving hammer must be lifted off of the mandrel to prevent damage to the pile driver. This results in additional delay in the pile forming process and consequently results in additional costs for the installation of the pile.

Also as can be seen in the above discussion, the foregoing prior art devices are specific for certain types of materials, for example, the DeWitt device can only be utilized for installing piles made of grout, but not stone. Accordingly, a pile forming enterprise must have access to separate apparatuses depending on the requirements of the job. This increases inventory costs, overhead and capital outlay.

What is needed is a single apparatus that is more durable when compared with single mandrel embodiments, that eliminates the need for an external casing that is left in the ground, that can be used in multiple piling forming situations, grout, stone, crushed rock, etc., and that can utilize a retrievable foot.

BRIEF SUMMARY OF THE INVENTION

The present invention is an apparatus and a method for either casting a pile in the ground or placing a stone column into the ground. Prior art methods incorporate driving a single mandrel, with a disposable driving boot. The present invention comprises a retrievable exterior driving casing and an interior mandrel and an optional retrievable driving boot as the situation requires. The exterior casing is sized to the desired hole dimensions and the interior mandrel is filled with grout, stone (crushed or un-crushed), sand, cement or some combination thereof.

The interior mandrel is sized so as to easily slide along the interior annular space of the exterior casing. The apparatus is driven into the ground using known pile driving methods. During penetration into the soil, depending on the type of soil encountered and the type of pile to be formed, grout, air or water flows into the surrounding earth through aligned apertures on the exterior casing and the interior mandrel; this prevents necking, and provides a temporary frictionless medium to allow easy extraction of the apparatus. When the bottom of the apparatus reaches the desired depth, the interior mandrel is lifted out of phase relative to the exterior casing by raising it a predetermined distance relative to the exterior casing. This allows the pile forming materials to flow out the bottom of the apparatus. After lifting the interior mandrel a certain distances, the exterior casing is caused to be lifted.

The exterior casing maintains the integrity of hole as the pile forming material flows into the space created by the apparatus. Accordingly, the tendency to form voids and necks is substantially reduced. Additionally, because the apparatus comprises an exterior casing and an interior mandrel, the tubes may be made of thinner walled material than a conventional single mandrel, with the added advantage that the double tubes will be sturdier than a single mandrel having a thicker wall. This characteristic of double wall construction has been shown in performance and durability of double walled aluminum baseball bats when compared with single walled aluminum baseball bats.

Other features and advantages of the present invention will become apparent from the following detailed description taken into conjunction with the accompanying drawings which illustrate by way of example the principles of the invention.

DETAILED DESCRIPTION OF THE PREFERRED EMBODIMENT

The invention comprises a pair of tubes with a first tube having a top and bottom. The bottom of the first tube comprises an open bottom and has an interior profile, the preferred profile is frusto-conical. The second tube having a top and bottom. The bottom of the second tube having a preferred exterior profile that is adapted to mate with the interior profile of the first tube, thereby sealing the open bottom of the first tube when the profiles come into contact with each other. Open slots are provided for in the profile of the second tube to allow transfer of material from the interior of the second tube out through the open bottom of the first tube when the profiles disengage. A more specific detail of the preferred embodiment is further discussed below.

Figure 1:
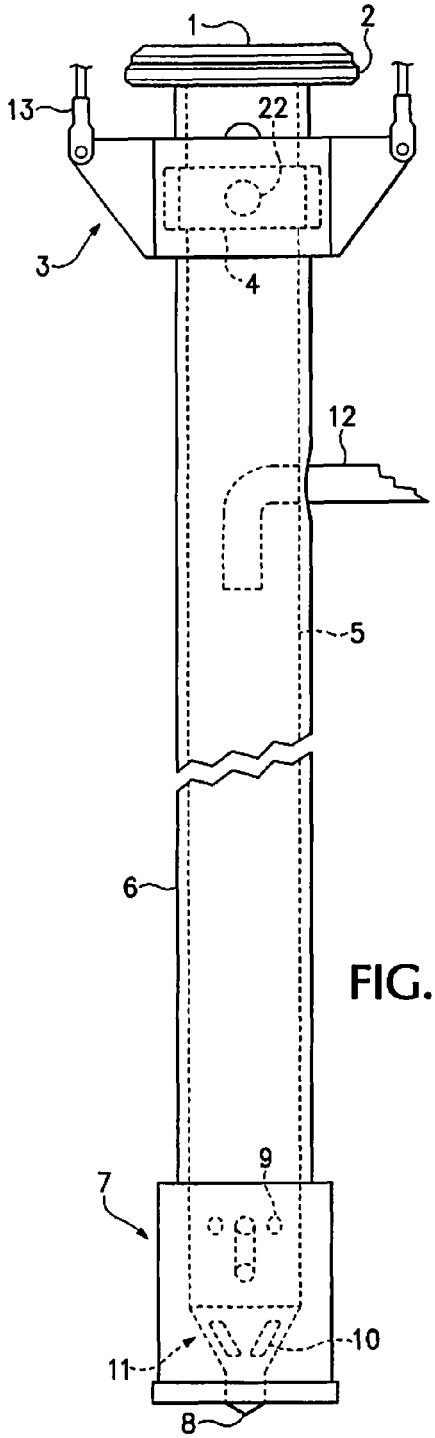
FIG. 1 is a frontal view of an embodiment according to the invention.

The preferred embodiment 100 comprises an exterior casing 6 and an interior mandrel 5. See, e.g, FIG. 1. The casing 6 and mandrel 5 may be of any cross section so long as mandrel 5 is able to fit slidably within casing 6. Each of the tubes have an upper end and a lower end. At the upper end of mandrel 5 is a first pile driver receiving plate 1, which receives direct blows from a pile driver. Pile driver plate 1 in turn rest on a second plate 2 having an annular opening, whereby mandrel 5 may be inserted there through. Plate 2 is attached to the top end of casing 6. When the pile driver (not shown) strikes plate 1, the energy of the strike A is transmitted to plate 2, which in turns drives casing 6 into the ground. Accordingly, casing 6 bears the majority of the stresses in driving apparatus 100 into the ground.

Compound collar assembly 3 provides the means in which device 100 is to be lifted or extracted from the ground. Referring to the FIGS. 2 and 3, collar assembly 3 comprises an external lifting collar 14, which encloses internal collar 4. External casing 6 fits slidably within and through collar 4. Although the drawings shows collar 4 as a bolted on structure, collar 4 may also be a structure of a uniform ring. Collar 14 has an annular space 27 (see FIGS. 2 & 3) in which interior collar 4 fits within. Lifting collar 14 is lifted by known lifting means such as cables 13, which may be attached to a crane (not shown). As collar 14 is lifted by cables 13, collar 14 engages interior collar 4 at 56, which lifts mandrel 5. Internal collar 4 is affixed proximate to an upper portion of mandrel by pin 22. However, collar 4 may be affixed to mandrel 5 by any number of methods, such as screws or bolts and the like, welding, or mandrel 5 and collar 4 can be casted or machined as a single item. In the preferred embodiment, pin 22 extends through a steel restraining member 40. Member 40 is restrained and securely affixed within the upper portion of mandrel 5. Member 40 may be made of any substantial and study material, e.g., a solid steel plug, steel plating, or steel hollow metal cylinder. The ends of pin 22 extends out from opposing sides of the exterior of mandrel 5 and are fixed in a position located proximate to the upper portion of mandrel 5. The ends of pin 22 interlocked with collar 4, accordingly, so as pin 22 rides along and is restrained within slot 21 of casing 6 so does collar 4. Slot 21 is a located proximate the upper portion of casing 6. Therefore, as collar 4 moves up and down slot 21 so does mandrel 5 in relation to casing 6. This can be seen when comparing FIGS. 2 and 3. Therefore, the interaction between pin 22, collars 4 and 14, and the bottom ledge of plate 2, cause mandrel 5 to be displaced in relation to casing 6 when upward force B is applied.

Figure 2:
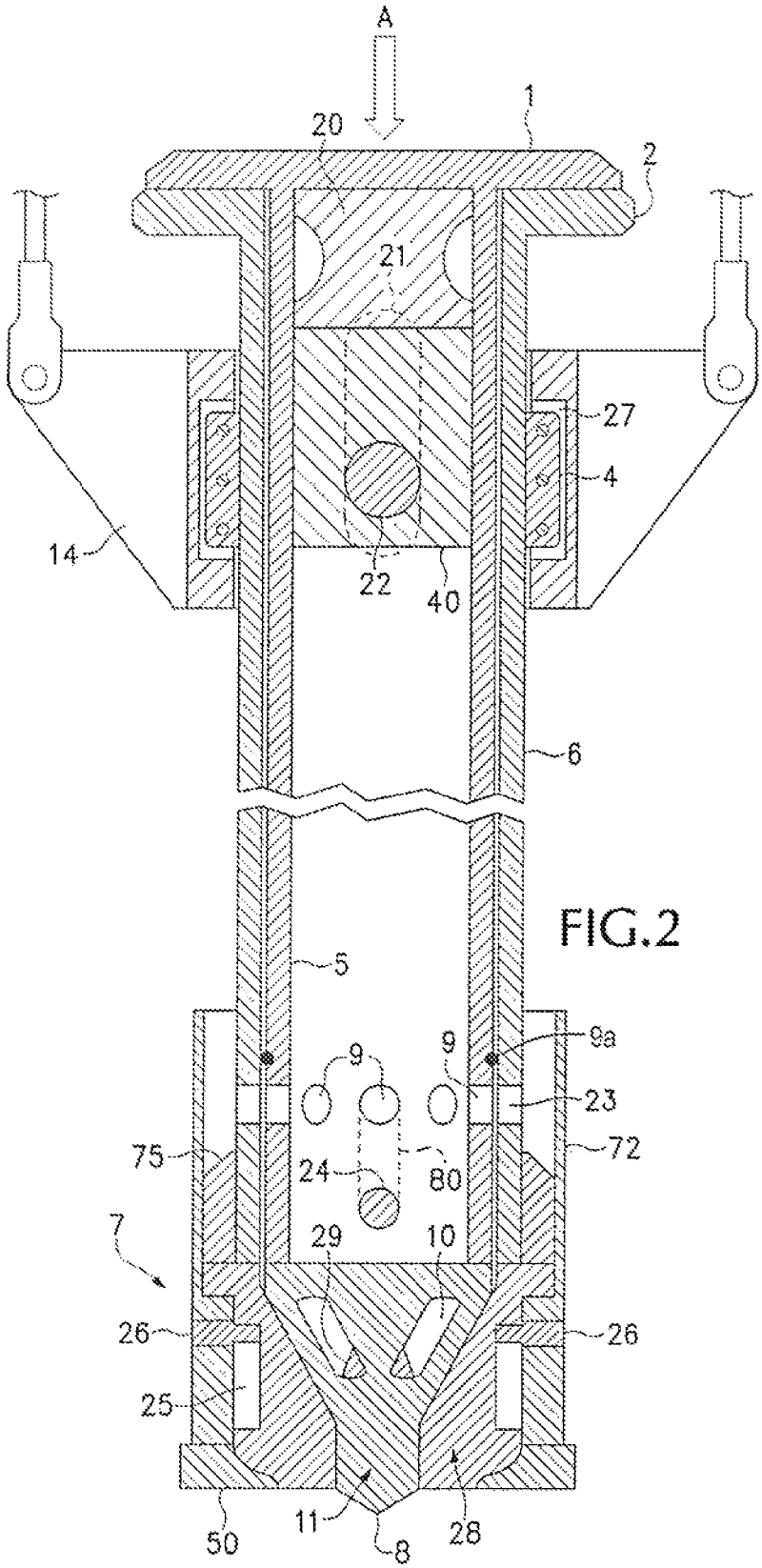
FIG. 2 is a cross-sectional view of the embodiment of FIG. 1 as the invention would appear when being driving into the ground.

During the driving process, pile driving hammers offer cause pile mandrels to spiral which in turn would cause lifting cables to wind and tangle. This is avoided in collar assembly 3. In FIG. 2, cables 13 exert no lifting force and therefore, interior collar 4 floats within annular space 27, thus casing 6 may twist and turn with relative freedom within annular void 27, without affecting cables 13.

Suppressor 20 is located directly above member 40. Suppressor 20 is made from material possessing an ability to dampen vibrations, such materials can either be a natural material such as rubber or a synthetic elastomer. Suppressor 20 as the drawings show is sandwiched between plate 1 and member 40. The utility of suppressor 20 is discussed below.

At the bottom of apparatus 100 are sealing means to control the release of grout or other pile forming materials. In the preferred embodiment, the sealing means comprise a pair of mating frusto conical profiles which is discussed as follows. At the bottom end of casing 6 is ground contacting member 28, which comprises an open top end 32 and an open bottom end 31. See FIGS. 2 and 3. Open top 32 end is located at the bottom end of casing 6, and has an annular cross-sectional area with a downward facing frusto-conical profile. Open top end 32 has a larger cross-sectional area than open bottom end 31. Ground contacting member 28 may be attached to the bottom of casing 6 either by a variety of means, such as screws, bolts, or by welding. Attached to the bottom end of mandrel 5 is member 11 which has a substantially downward facing frusto-conical profile that is adapted to mate with ground contacting member's (28) annular downward facing frusto-conical profile when the profiles come into contact with each other. Member 11 also comprises a plug 8 which seals open bottom end 31, an upward facing conical member 29, and a plurality of elongated openings or slots 10 located radially along the upper portion of member 8. The upper portion of member 11 is hollow, thereby allowing pile forming materials to exit openings 10 and migrate from the interior of mandrel 5 into the surrounding earth when the profiles are disengaged for each other. Conical member 29 facilitates the dispersal of the pile forming materials out through openings 10.

Located proximate to the bottom portion of casing 6 are a plurality of apertures 23. During the driving of apparatus 100 into the ground, apertures 23 are in flow-through alignment with apertures 9, which are located proximate the lower portion of mandrel 5.

This flow-through alignment of apertures 9 and 23, depending on the type of pile being formed, enable cementitious fluid, water, or compressed air to exit from the interior of mandrel 5 and into the surrounding earth. In the case of installing a stone column air may be forced through these openings. This is discussed in further detail below.

When it is time to form the pile, cables 13 exert an upward force B. Mandrel 5 is lifted prior to casing 6 being engaged and lifted. See FIG. 3. This out of phase lifting of casing 6 and mandrel 5 results in lower plug 8 being lifted and unsealing the open bottom end 31, which in turn allows the contents within mandrel 5 to be released through elongated slots 10, out open bottom end 31 and into the hole created by apparatus 100. As force B continues to lift mandrel 5, collar 4 will ultimately engage the bottom of plate 2 at 55, and thereby lift both casing 6 and mandrel 5. During the entire lifting period, the hole is being filled with the contents of mandrel 5.

Although not shown in the drawings, apparatus 100 may incorporate the use of one or more "O" rings 9*a* to ensure an effective seal against unwanted grout, air, or water seepage when apertures 9 and 23 are out of phase. The "O" rings 9*a* would be mounted on lower portion of mandrel 5 to a position above aperture 9 sealing the annular space between the exterior of mandrel 5 and the interior of casing 6. The "O" rings 9*a* may be made of any suitable elastomeric material that would be commonly used for the purpose of creating a seal, much like the piston rings of an automotive gasoline engine.

Apparatus 100 may also be equipped with an optional foot assembly 7. Such an assembly would be used when installing a pile formed from grout. As shown in the figures, foot assembly 7 is attached at the bottom of the exterior of casing 6 and encloses member 28. Foot assembly 7 includes a plate 50, which is made of a sturdy material such as steel for contacting and penetrating the ground, cylindrical sidewall 72 which extends up over the lower portion of the member 28, a plurality of removable bolts or screws 26 that are positioned radially proximate the lower portion of foot 7, and sealing ring 75 with a sealing ring pin 24 which ride along in slot 80. One end of bolts 26 rides along and is retrained within a channel 25. Channel 25 is located on the circumferential surface of member 28. The boot is restrained to member 28 when bolts 26 are screwed in and ride up and down channel 25. If foot assembly 7 is not desired, bolts 26 are removed and foot assembly 7 may slide off member 28.

Sealing ring 75 comprises an annular ring of a sturdy material such as steel that circumferentially surrounds the a lower portion of the exterior casing 6. Sealing ring 75 is adapted so that it slideably fits around exterior casing 6. During the driving process, sealing ring 75 is situated lower than the top edge of cylindrical sidewall 72 and below aligned apertures 9 and 23. as shown in FIG. 2, so as not to hinder the flow of grout, air or water as the case may be, to enter the surrounding earth. When foot assembly is not used, ring 75 may be removed by removing pin 24 and sliding ring 75 off casing 6; ground contacting member 28 would also have to be removed.

Sealing ring 75 is activated via pin 24. Pin 24 is rigidly located proximate to the lower end of mandrel 5, so as mandrel 5 traverse up and down within casing 6, so does pin 24. The distal ends of pin 24 extend through casing 6 and are interlocked into ring 75, therefore, as pin 24 travels so does ring 75. The travel of pin 24, however, is confined within the boundaries of lower slot 80. Lower slot 80 is located on the lower portion of casing 6. As indicated in the figures, slot 80 is aligned parallel to the length of both casing 6 and mandrel 5.

Figure 4:
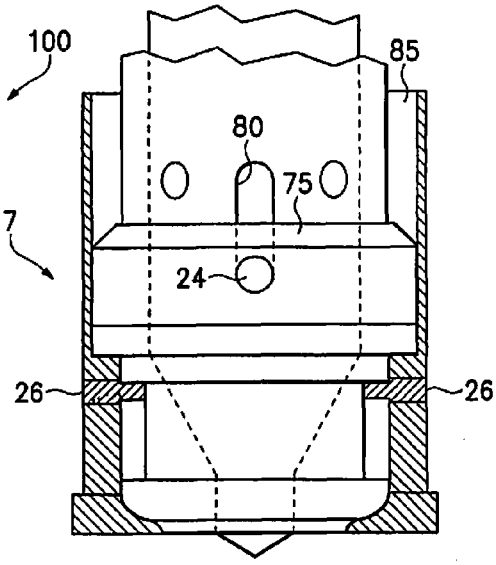
FIG. 4 is a partial view emphasizing the lower portion of the embodiment as shown in FIG. 2.
Figure 5:
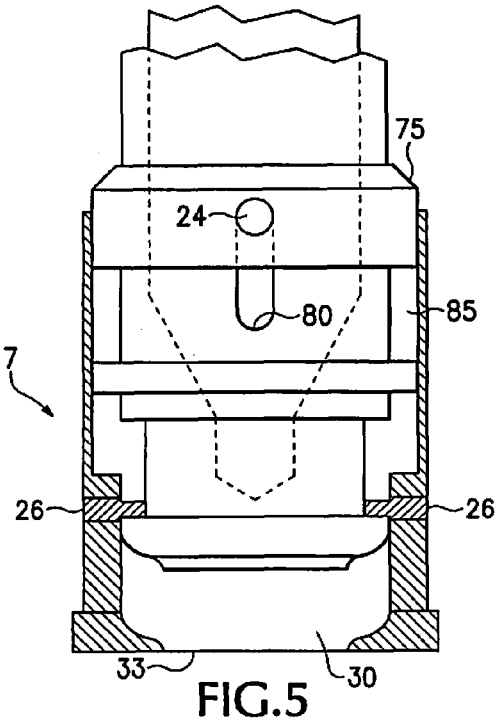
FIG. 5 is a partial view emphasizing the lower portion of the embodiment as shown in FIG. 3.

Accordingly, when force B causes exterior collar 14 to engages interior collar 4 at point 56, thereby causing mandrel 5 to be upwardly displaced in relation to casing 6, pin 24 being interlocked to ring 75 causes ring 75 to also be displaced from its first position as seen in FIG. 4 to a second position, as seen in FIG. 5, whereby, ring 75 seals the annular space 85 between the exterior of casing 6 and the interior of sidewall 72. This sealing of annular space 85 aids in the extraction of device 100 from the earth by preventing debris from the surrounding earth from entering annular space 85 and clogging the extraction process or hanging up the device.

Figure 3:
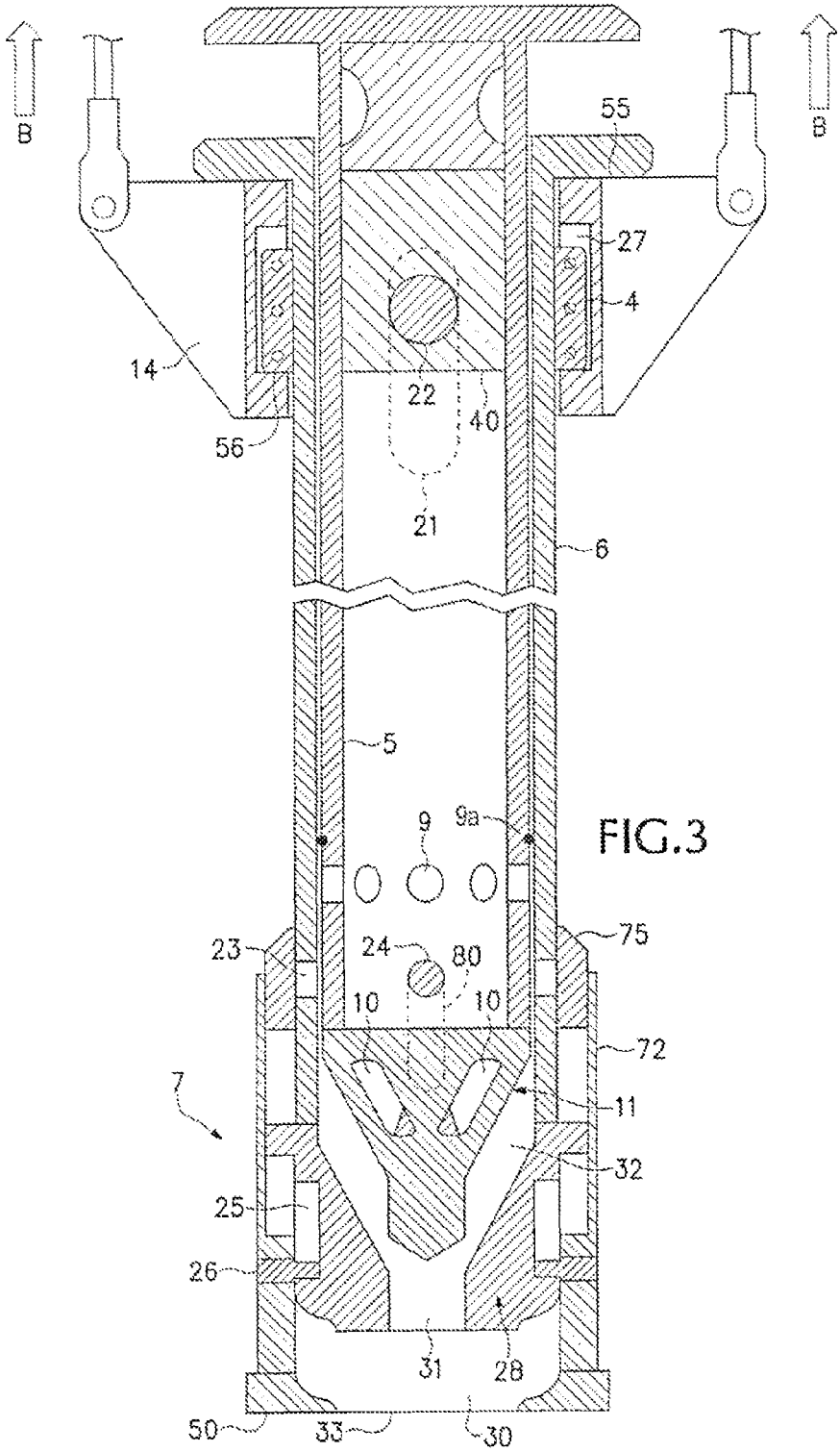
FIG. 3 is a cross-sectional view of the embodiment of FIG. 1, as the invention would appear when being retracted from the ground.

Another novel aspect of foot assembly 7 is that it provides a plume forming chamber 30 to facilitate the effective dispersal of grout into the surrounding earth. As shown in FIGS. 3, 4, and 5 during the extraction process mandrel 5 is displaced first in relation to casing 6, when the upper portion of collar 14 engages the bottom of plate 2 at 55, casing 6 begins to lift and is displaced in relation to the surrounding earth, accordingly, ground contacting member 28 lifts as casing 6 lifts, thereby causing the formation of chamber 30.

Grout enters chamber 30 forming a steady state reservoir of grout, i.e., the level within the reservoir will remain steady provided there is sufficient grout be delivered via mandrel 5 as the grout exits out opening 33 of chamber 30. Opening 33 as the figures show is larger in cross-sectional area than that of opening 31. As apparatus 100 continues to lift from the ground, ground contacting member 28 engages foot assembly 7 when lifting bolt 26 contacts the bottom of channel 25. At that point grout flows out of the grout reservoir formed in chamber 30 and into the surrounding earth. The affects of the chamber and the resultant reservoir causes the grout to flow more uniformly and widely into the earth.

Another novel aspect of foot assembly 7, is that the foot is not left in the ground, but retrieved for subsequent and multiple use. This is advantageous as steel is not wasted and thus results in cost savings. The use of optional foot assembly 7 may be used where the desired hole dimensions is larger than can be created with casing 6.

Accordingly, optional foot assembly 7 facilitates the flow, distribution, and placement of the pile forming material and can be adapted to the particular characteristics of pile forming material that is to be placed into the earth.

In use, apparatus 100 is driven into the earth using known pile driving techniques and equipment. During the driving process, apertures 9 and 23 are in alignment, thereby allowing grout to flow from the interior of mandrel 5 through the apertures and into the surrounding earth. This provides fluid grout to lubricate the result pile hole to facilitate extraction of the apparatus 100 fills any voids with grout. Pile driving force A maintains the plates 1 and 2 flush against each other and maintains the seal caused by the mating between the annular conical profile of ground contacting member 28 with the conical profile of mandrel end member 11.

When the desired depth is obtained, collar assembly 3 is use to lift the apparatus and extract apparatus 100. See FIG. 3. During the extraction process, casing 6 and mandrel 5 are lifted out of phase, in that, mandrel 5 is first lifted and advances a certain distance prior to casing 6 being also lifted. When casing 6 begins lifting, both tubes are then lifted in unison.

As mandrel 5 is displaced in an upwards direction from casing 6, member 11 unseats from ground contacting member 28, thereby creating an annular space. See FIG. 3. This causes grout to flow out of elongated slots 10, out the bottom opening 31, and into the surrounding earth.

Apparatus 100 may also be use to place stone column into the ground. When installing a stone pile optional foot 7 assembly would be used. Instead of a grout delivery system as illustrated by 15, apparatus 100 is equipped with a hopper (not shown), which supplies stone or crushed rock. Mandrel 5 is not prefilled with stone, rocks and the like. Compressed air or water is supplied to the annular space between casing 6 and mandrel 5. In the placement of stone piles/columns, air or water is used to stabilize the surrounding earth as the device is being driven into the ground.

The compressed air or water that is forced into the annual space between exterior casing 6 and mandrel 5 exits casing 6 through apertures 23 and into the surrounding earth. When the desired depth is reached, the hopper fills mandrel 5 with stone/rock, and the lifting procedure as described above begins. In addition, the lifting and depositing of stone may be halted and driving may restart so as to further compact the forming stone column. The water or compressed air that exits through aperture 23 assists in the extraction of the apparatus from the ground. When using apparatus 100 for installing stone or rock pile, optional foot 7 is not required.

In addition apparatus 100 easily accommodates the application of vibration equipment. As as shown in the drawings, a suppressor 20, which is made of an elastomeric material may be inserted within mandrel 5. It is a common practice when placing stone columns to attached a vibrator to the mandrel. See, for example, the discussions in Goughnour, U.S. Pat. No. 5,279,502.[1] In apparatus 100, it is anticipated that a driving hammer will be used to drive the apparatus into the earth. Accordingly, after driving, the hammer will rest on plate 1. If a vibrator is used, suppressor 20 will substantially reduce the vibrations being transmitted to the hammer. Excessive vibrations to the hammer may cause damage to the pile driving equipment. Accordingly, no additional time or procedures will be required to remove the hammer from driving plate 1. The hammer can ride on top of driving plate 1 during the entire lifting and vibrating process.

1 U.S. Pat. No. 4,397,588, Col. 1. (regarding Vibroflot)

A preferred embodiment of the invention has been described and illustrated for purposes of clarity and example, it must be understood that many changes, substitutions and modifications will become apparent to those possessed of ordinary skill in the art without thereby departing from the scope and spirit of the present invention which is defined by the following claims.

What is claimed is:

1. An apparatus for installing a subterranean pile comprising, a) a first elongate tube comprising a top and a bottom portion, an outlet located at said bottom, an exterior surface, an interior surface, and a interior profile located within the interior surface of said bottom portion;

b) a second elongate tube being slidably located within said first tube, comprising a top and a bottom portion, an exterior profile located on the exterior of said second tube's bottom portion, said exterior profile adapted to mate with said interior profile of said first tube, wherein when said profiles come into contact with each other said outlet of said first tube is sealed, at least one opening on said second tube's exterior profile allowing communication between an interior and an exterior of said second tube;

c) a collar assembly encircling proximate the upper portion of said tubes, comprising a first collar and a second collar, said first collar encapsulating said second collar, whereby, an annular space is provided for said second collar to move slidably within said first collar both longitudinally and rotationally, said second collar slidably encircling said first tube and securely affixed to said second tube, whereby when said second collar is displaced longitudinally along said first tube said second tube moves in unison with said second collar.

2. The apparatus of claim 1, further comprising a first plurality of apertures located proximate first tube's bottom portion and a second plurality of apertures located proximate second tube's bottom portion, wherein when said profiles are in contact with each other, said pluralities of apertures are in flow-through alignment thereby allowing communication between the interior of said second tube and an exterior of said first tube.

3. The apparatus of claim 1, wherein said interior profile of said first tube comprises a downward facing frusto-conical first member, and said exterior profile of said second tube comprises a downward facing frusto-conical second member, said first and second members adapted so that said interior profile of said first member will mate with said exterior profile of said second member when said first and second members contact each other.

4. The apparatus of claim 3, wherein said second downward facing frusto-conical member further comprises a plug located proximate the bottom of said second downward facing frusto-conical member.

5. The apparatus of claim 1, further comprising a retrievable driving shoe assembly that is attached and slidably restrained to an exterior of said first tube's bottom portion, said shoe comprising a grout dispersal chamber and an outlet wherein grout exits said shoe, said chamber located between an outlet of said second tube and an outlet of said driving shoe.

6. An apparatus for installing a subterranean pile comprising:

a) a first tube having a top portion, a bottom portion, and a slot located proximate said top portion;

b) a first plate having an annular opening, said first plate affixed to the top portion of said first tube;

c) a ground contacting member with an open top end and an open bottom end, said ground contacting member's open top end attached and affixed to the bottom portion of said first tube, said ground contacting member having an annular cross-sectional area with a downward facing frusto-conical profile, wherein said open top end of said ground contacting member has a larger cross-sectional area than said open bottom end of said ground contacting member;

d) a second tube adapted to slidably fit through said first plate and within said first tube and having a top portion, a bottom portion, and a second plate, said second plate attached on said top portion of said second tube and adapted to receive force from pile driving means, said bottom portion of said second tube having an exterior downward facing frusto-conical profile adapted to mate with said ground contacting member's annular downward facing frusto-conical profile, said bottom portion of said second tube adapted to substantially seal said open bottom of said ground contacting member; said bottom portion of said second tube having a plurality of openings radially located along said frusto-conical profile of said bottom portion, said bottom portion further comprising an upward facing conical member within an annular space of said second tube's bottom portion;

e) a first plurality of apertures located proximate to said bottom portion of said first tube and a second plurality of apertures located proximate to said bottom portion of said second tube, wherein when said first and second pluralities of apertures are in alignment communication is allowed between an interior of said second tube through to an exterior of said first tube and wherein, when said pluralities of apertures are in disalignment there is no communication between the interior of said second tube with the exterior of said first tube; and (f) a collar assembly located beneath said first plate encircling said first tube, said collar assembly comprising an exterior collar, and an interior collar said exterior collar encircling said interior collar, said interior collar encircling and restrained to an upper portion of said second tube.

7. The apparatus of claim 6 further comprising a suppressor located within said second tube beneath said second plate.

8. The apparatus of claim 7, wherein said suppressor is one of natural resilient material or of synthetic material.

9. The apparatus of claim 6, further comprising a plurality of "O" rings, said "O" rings being located at a position above said first plurality of apertures located on said first tube aperture.

10. The apparatus of claim 9, wherein said "O" rings are made of an elastomeric material.

11. The apparatus of claim 6, further comprising a retrievable driving foot attached and slidably restrained to the exterior of said first tube's bottom portion, said foot comprising a chamber and an outlet wherein pile forming materials exits said foot, said chamber located between an outlet of said second tube and an outlet of said driving foot.

12. The apparatus of claim 11, wherein said retrievable foot further comprises a) annular sidewalls extending to a position above said pluralities of pluralities of apertures of the first tube and the second tube when said apertures are in flow through alignment;

b) foot restraining means to slidably restrain said foot to said ground contracting member; and wherein said ground contacting member further comprises a channel located along an exterior surface of said ground contacting member where said restraining means slidably fits therein.

13. A method to place an in-ground pile comprising the following acts:

a) providing a first tube, said first tube having having bottom portion and a top portion, said bottom portion of said first tube having an interior profile and an open bottom;

b) providing a second tube adapted to slidably fit within said first tube, said second tube having a top portion and a bottom portion, said second tube bottom portion having an exterior profile, whereby said exterior profile of said second tube mates with said interior profile of said first tube, thereby sealing the open bottom of said first tube, said exterior profile further comprising a plurality apertures allowing communication the interior of said second tube and the exterior of said second tube;

c) inserting said second tube into said first tube until the open bottom of said first tube is sealed;

d) driving both tubes into a ground using pile driving equipment to a depth determined by a user;

e) placing pile forming materials into said second tube, said pile forming materials being essentially one of cementitious fluid, stone, crushed rock, cement, and combinations thereof;

f) lifting said second tube whereby said bottom of said first tube becomes unsealed;

g) delivering said said pile forming materials from the interior of said second tube through said apertures and out through said open bottom of said first tube;

h) lifting said first tube after said first tube bottom becomes unsealed; and i) removing both tubes from the ground.

14. The method of claim 13, wherein said pile forming material is cementitious fluid, and further comprising the step of attaching a retrievable driving foot to the open bottom of said first tube, said driving foot being attached and slidably restrained to an exterior of said first tube's bottom portion, said foot comprising a grout dispersal chamber and an outlet wherein said cementitious fluid exits said foot, said chamber located between an outlet of said second tube and an outlet of said driving shoe.

15. The method of claim 14, wherein said first tube and said second tube further comprise a first plurality of apertures on said first tube and a second plurality of apertures on said second tube, and wherein step e) comprises the step of aligning said first plurality of apertures with said second plurality of apertures thereby allowing said cementitious fluid to migrate from an interior of said first tube out through said first plurality of apertures and into the ground.

16. The method of claim 15, wherein step h) further comprises misaligning said first and second pluralities of apertures.

17. The method of claim 13, wherein said pile forming material is one of stone, crushed rock and combinations thereof.

18. The method of claim 17, wherein after step h), further comprising the steps of halting the delivery of said pile forming materials, driving said tubes downward so as to compact the pile forming material, and resuming the lifting of the tubes until the tubes are extracted from the ground.

19. The method of claim 17, wherein a suppressor is provided and affixed within the interior of the top portion of said second tube, and comprising the further step of vibrating said tubes during the delivery of said pile forming material.

20. The method of claim 19, wherein, said pile driving equipment is allowed to remain in contact with said tubes.

* * * * *